US005791121A

United States Patent [19]

Bernier

[11] Patent Number: 5,791,121

[45] Date of Patent: Aug. 11, 1998

[54] APPARATUS FOR ATTACHMENT OF CARRIER SHEET TO CONTAINERS

[76] Inventor: Bayne Bernier, 12 Spruce St., Greenfield, Mass. 01301

[21] Appl. No.: 598,151

[22] Filed: Feb. 7, 1996

[51] Int. Cl.[6] ..... B65B 27/04; B65B 67/00

[52] U.S. Cl. ..... 53/398; 53/48.3; 53/390

[58] Field of Search ..... 53/398, 48.3, 48.4, 53/441, 556, 295, 390

[56] References Cited

U.S. PATENT DOCUMENTS

| | | | |
|---|---|---|---|
| 2,929,181 | 3/1960 | Poupitch . | |
| 3,032,944 | 5/1962 | Hull et al. | 53/48.4 |
| 3,404,505 | 10/1968 | Hohl et al. . | |
| 3,509,684 | 5/1970 | Hohl et al. | 53/48.3 X |
| 4,121,401 | 10/1978 | Duerr et al. | 53/398 |
| 4,188,249 | 2/1980 | Fujio | 156/165 |
| 4,354,334 | 10/1982 | Hara | 53/48.4 |
| 4,392,337 | 7/1983 | Hara | 53/48.4 |
| 5,385,000 | 1/1995 | Bakhtyari | 53/398 X |

*Primary Examiner*—Horace M. Culver

[57] ABSTRACT

An apparatus is adapted to attach a plastic carrier sheet about the upper edge of a plurality of containers to secure them together as one unit for easier carrying. The apparatus includes a base portion which properly positions the containers below a lower plate that is slidably mounted to vertical supports. A plurality of engagement means, secured to the lower plate, have a plurality of fingers which are adapted to grasp a discrete generally conical member. A release mechanism secured to the lower plate releases the conical members from the engagement fingers onto the upper surface of the containers to allow the carrier sheet to be fitted onto the conical members. The carrier sheet is then fitted onto the containers by lowering the lower plate causing the fingers to force the carrier sheet over the conical member and onto the upper portion of the container. The lower plate is raised and lowered by a lifting mechanism mounted to the lower plate.

14 Claims, 7 Drawing Sheets

APPARATUS FOR ATTACHMENT OF CARRIER SHEET TO CONTAINERS

FIELD OF THE INVENTION

This invention relates to an apparatus for attaching a plastic carrier sheet to a plurality of containers to enable them to be carried as a single unit.

BACKGROUND OF THE INVENTION

Various methods are presently known for packaging a group of containers, such as beverage cans. One such method is to employ a carrier formed of plastic sheet material that has a plurality of loops defining associated openings adapted to fit around the upper edge of the cans. The openings are typically arranged in two rows of three to form a "six-pack" of cans when secured to the carrier.

The cans typically have a lip disposed about the outer periphery of the upper edge of the can. The cans are fitted through the openings so that the carrier is secured to the cans just below their upper lip. The diameter of the openings defined by the carrier is less than the diameter of the lip of the container to provide a snug fit.

The plastic carriers are usually attached to the cans at a bottling plant having large, complex conveyorized equipment capable of assembling a great number of six-packs in a short period of time. This equipment is, however, impractical and uneconomical for use by small businesses or individuals.

Many businesses, such as package stores, grocery stores and distribution centers, must be able to quickly and easily repackage containers that may have fallen out of the carrier during shipping and handling. The containers are typically repackaged by hand which is a difficult and very time-consuming process. Each can must be fit into an opening of the carrier by stretching a respective loop over the upper lip of the can. Another drawback of repackaging by hand is that the loops may be overly stretched, causing the cans to fall from the carrier.

U.S. Pat. No. 4,392,337 discloses an apparatus for attaching a plastic carrier sheet to containers suitable for use on a small scale. The apparatus comprises a plurality of collapsible funnel members adapted to engage the upper edge of the containers and sleeve members coaxially disposed about the funnel members. The funnel and sleeve members are mounted to a sleeve support plate.

The carrier sheet is inserted over the funnel member by collapsing the diverging funnel portion so that its diameter is smaller than the openings defined by the loops of the carrier sheet. The funnel member collapses and retracts into the sleeve when the sleeve support plate pivots away from the bottom plate and is forced against a pressure pin. As the plate is pivoted and lowered, the funnel member extends from the sleeve member to expand and retain the carrier sheet thereon and engages the upper end of the containers. As the sleeve support plate continues to be lowered, the sleeve member outwardly flexes and slides downward along the outer surface of the funnel member, pushing the carrier sheet over the funnel member and about the peripheral edge of the containers.

The diverging portions of the funnel members have a fixed diameter which limits their use to cans having an upper lip of the same diameter. Moreover, the funnel members are not easily adaptable to cans having an upper lip diameter which varies from this fixed diameter. Another disadvantage is that the funnel members may not sufficiently collapse to permit a variety of carrier sheets having loops defining different shaped openings to easily fit onto the collapsed funnel members without stretching or deforming the loops.

SUMMARY OF THE INVENTION

Accordingly, it is the general object of the present invention to provide a lightweight, portable apparatus to quickly and easily attach a carrier sheet about the upper edge of a group of containers.

It is a further object to provide an apparatus easily adapted for use with a variety of carriers having loops defining openings of different shapes and sizes.

It is another object to provide an apparatus easily adapted for a variety of cans having upper edges that differ in size and shape from one another.

According to the present invention, an apparatus is adapted to attach a plastic carrier sheet about the upper edge of a group of containers to secure them together as one unit for easier carrying. The apparatus includes a base portion which properly positions the containers in the apparatus. A lower plate is disposed above the base portion and is slidably mounted to at least one vertical support. A plurality of engagement means, secured to the lower plate, are adapted to retain a plurality of discrete generally conical members and fit the carrier sheet over the conical members and onto the cans. The apparatus further includes a release mechanism for releasing the conical members from the engagement means and ejecting the conical members onto the cans. The lower plate is raised and lowered by a lifting mechanism mounted to the lower plate.

The above and other objects and advantages of this invention will become more readily apparent when the following description is read in conjunction with the accompanying drawings.

DETAILED DESCRIPTION OF THE PREFERRED EMBODIMENTS

Figure 1:
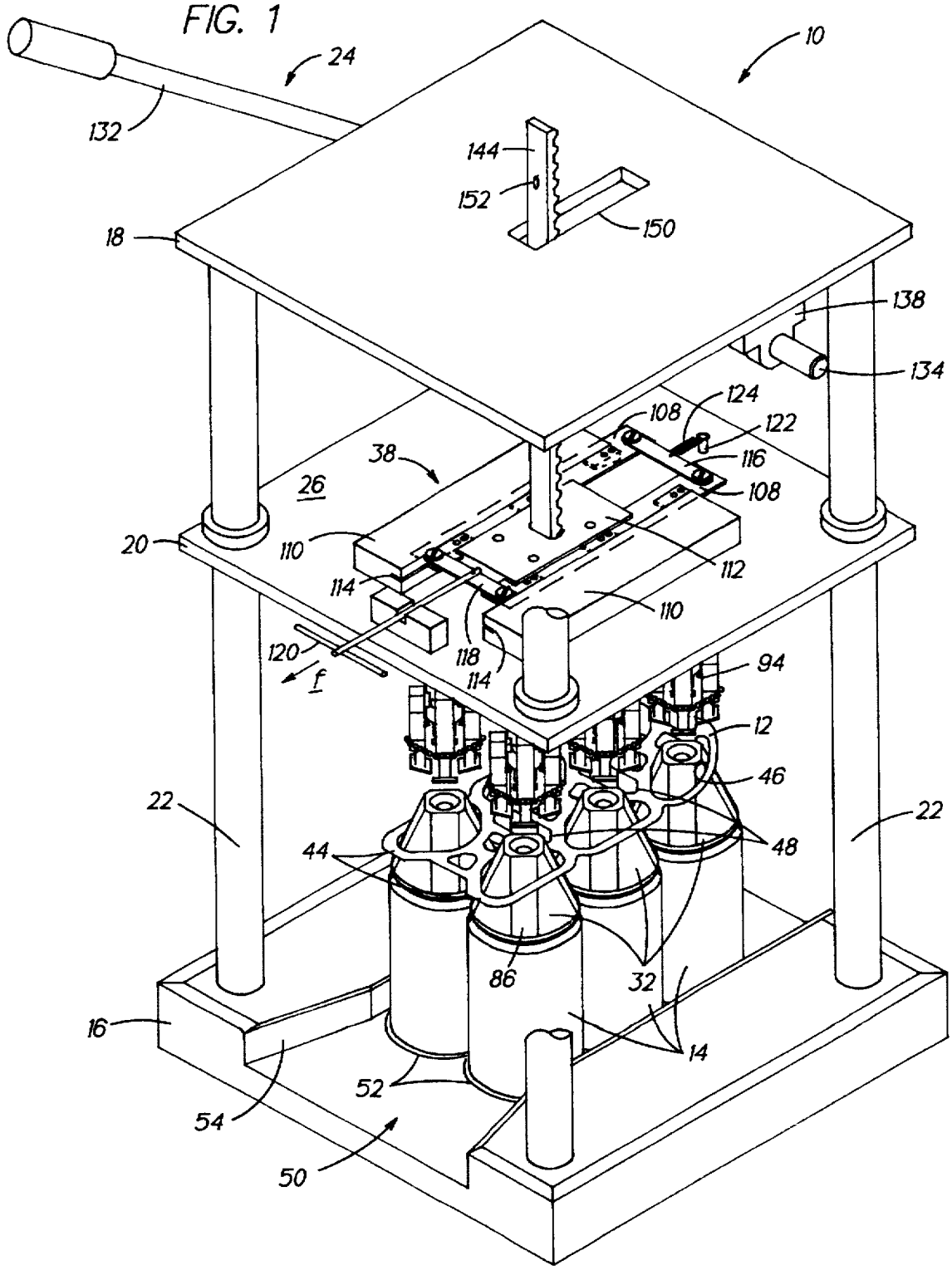
FIG. 1 is a perspective view of an apparatus for attaching a carrier to containers of the type embodying the present invention.

FIG. 1 shows a preferred embodiment of the present invention of an apparatus 10 for attaching a carrier sheet 12 about a plurality of containers 14, such as beverage and food cans to enable them to be carried as a single unit. The apparatus 10 is lightweight and portable, and ideal for use by businesses, such as supermarkets, package stores, and beverage distribution centers, that have a need to reattach cans 14 that may have fallen out of the carrier sheet 12 during shipping or breakdown larger units and repackage the cans into smaller units.

Figure 2:
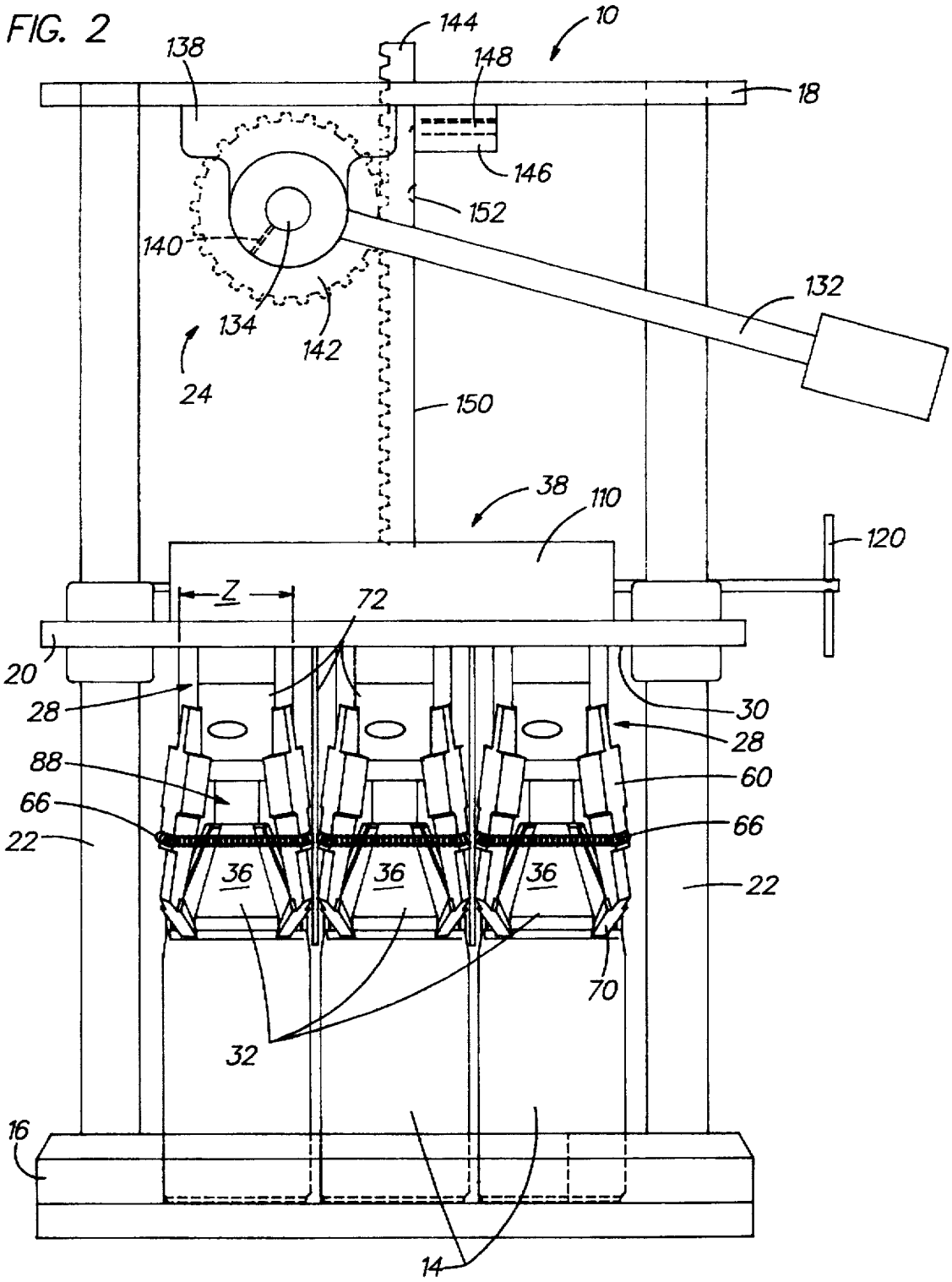
FIG. 2 is a side elevational view of the apparatus of FIG. 1.
Figure 7:
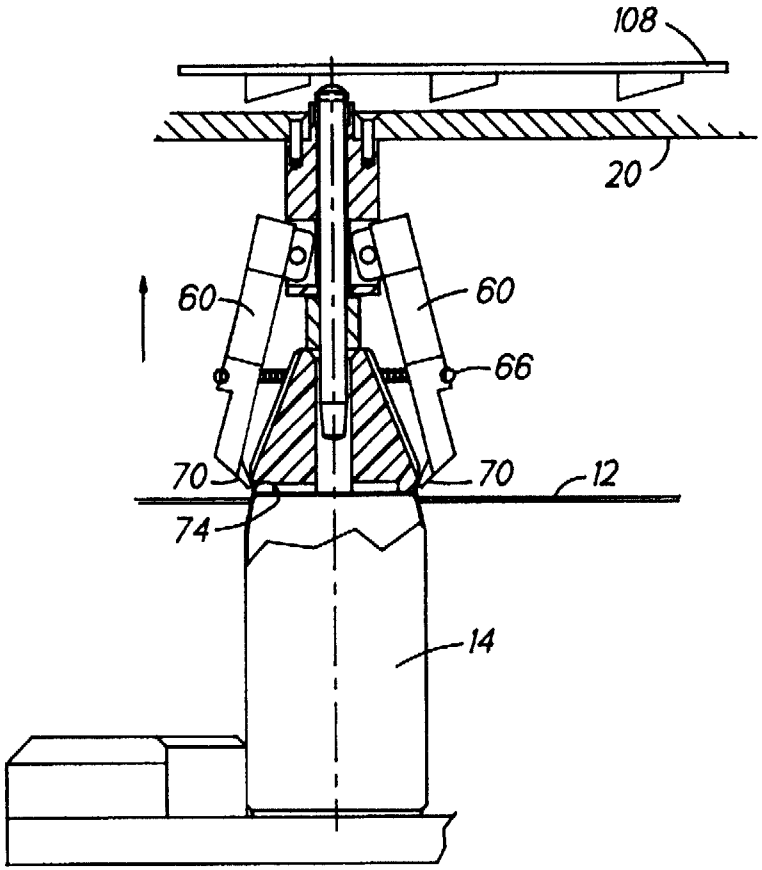
Figure 8:
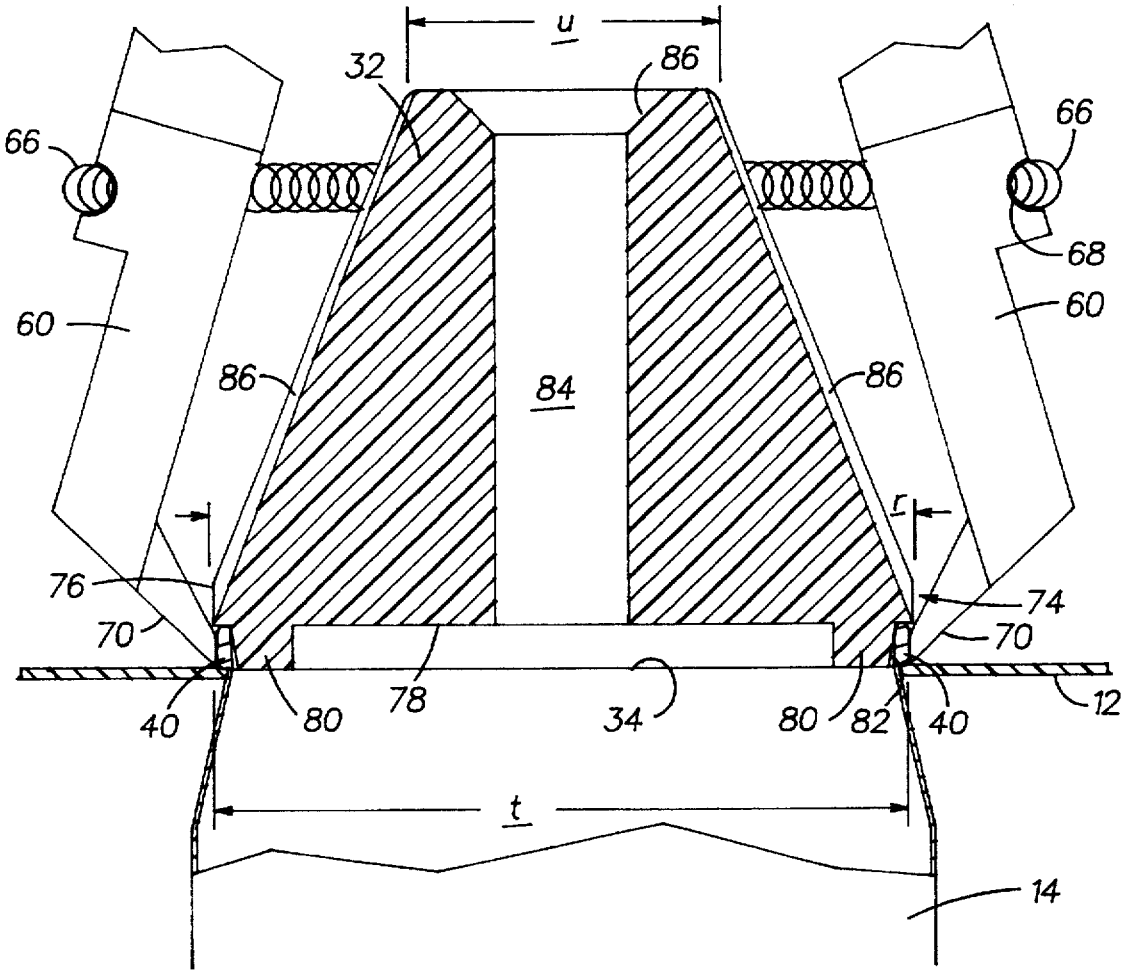
FIG. 8 is a side elevational view of a blown up portion of the conical member mounted atop the container of FIG. 7.

Referring to FIGS. 1 and 2, a preferred embodiment of the apparatus generally comprises a base portion 16, an upper plate 18 and a lower plate 20 horizontally supported above the base by a plurality of upright support members 22. The upper plate 18 is secured to the upper portion of the vertical support members 22, and the lower plate 20 slidably engages the supports intermediate of the base 16 and upper plate. The vertical movement of the lower plate 20 is controlled by a lifting means 24 supported by the upper plate and connected to the upper surface 26 of the lower plate 20. A plurality of engagement means 28, 28 are secured to the bottom surface 30 of the lower plate. The apparatus 10 includes a plurality of discrete conical members 32 adapted to engage the upper surface 34 of the cans 14 as shown in FIGS. 7 and 8. The engagement means 28 function to retain the conical member 32 therein, and engage the carrier strip 12 and outer surface 36 of the conical member to force the carrier over the conical member and onto the container 14. The apparatus also includes a release mechanism 38 mounted to the upper surface 26 of the lower plate 20 for ejecting the conical members 32 from the engagement means 28 onto the upper surface 34 of the cans 14.

Figure 3:
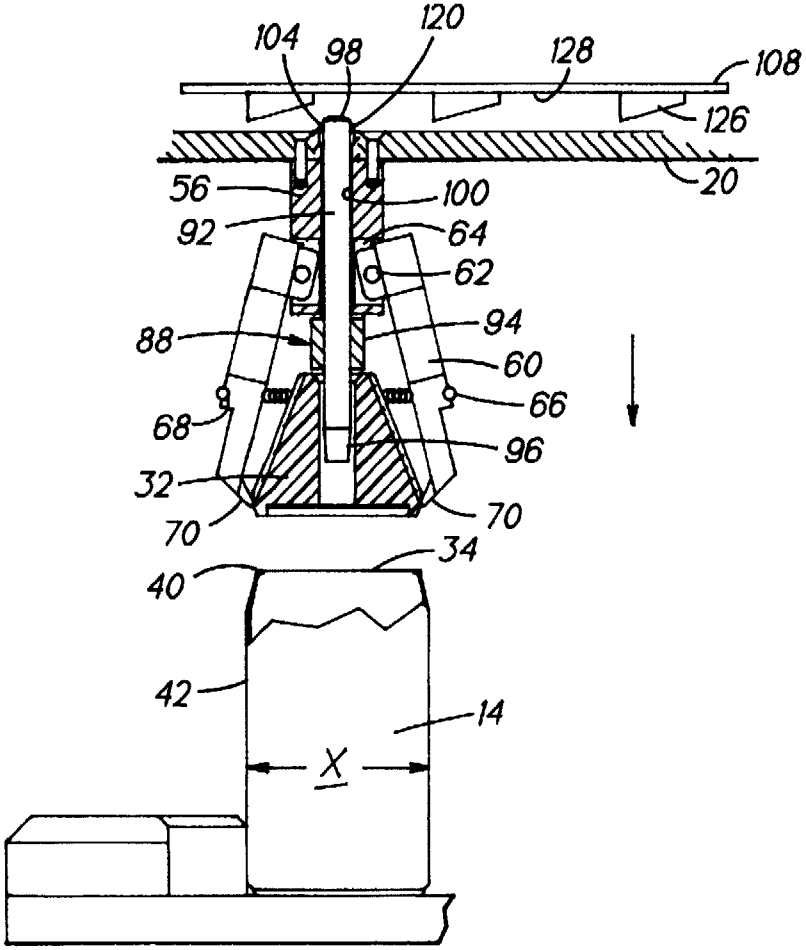

As shown in FIGS. 3 and 8, the cans 14, typically, have a lip portion 40 disposed about the periphery of the upper edge of the can and extending outwardly beyond the upper portion of the body 42 of the can.

Referring to FIG. 1, the carrier sheet 12 is formed of thin resilient, plastic sheet material and has a plurality of integrally connected loops 44 adapted to snugly retain the upper lip 40 of the can 14. Typically, the loops are arranged in two rows of three for retaining six containers 14 to form a six-pack of cans when carrier is secured to the cans. The loops typically define a generally circular opening 46 having a diameter slightly smaller than the diameter of the upper portion of the can body 42 so that when the carrier strip 12 is stretched over the lip 40 of the can, the loops contract back to their original diameter to securely retain the cans. The openings 46 defined by the loops may be triangular or elliptical in shape provided the width of the opening is less than the diameter of the lip 40 of the cans 14. The carrier 12 also includes openings 48 interposed between the loops which allows an individual to carry the cans as a single unit by inserting their thumb and fingers therein.

Referring to FIG. 1, the base 16 includes a groove 50 that extends from the front to the rear thereof for retaining and properly positioning the cans 14 below the engagement means 28 secured to the lower plate 20. The width w of the groove is approximately equal to twice the width or diameter x of a can body 42. The base 16 may also include a plurality of circular recesses 52 adapted to receive the bottom portion of the cans for proper positioning of the cans in the groove 50. The front end 54 of the groove 50 may be flared outwardly for ease of insertion of the cans 14 therein.

As best shown in FIGS. 2 and 3, the engagement means 28, 28 are secured to the bottom surface 30 of the lower plate 20 and are each centrally disposed over a respective can 14 positioned in the groove 50 of the base portion 16. Each engagement 28 means comprises a tubular member 56 mounted within an opening 58 disposed in the lower plate 20 and a plurality of fingers 60, 60 pivotally secured by a pin 62 within an elongated opening 64 in the outer surface of the tubular member 56. In the preferred embodiment, four fingers 60 are equi-spaced about the tubular member to provide sufficient contact with the outer surface 36 of the conical member 32 and the carrier sheet 12. A retention means 66, for example a spring and elastic band, for biasing the fingers together is disposed about the outer surface of the fingers 60. The retention means are maintained in its proper position about the fingers by a recess 68 disposed across the outer surface of each finger. The ends 70 of the fingers 60 inwardly extend, at an angle of approximately 30 degrees, to engage the outer surface 36 of the conical member 32. The fingers must be of sufficient length so that the ends 70 of the fingers extend beyond the upper lip 40 of the can 14 when the lower plate 20 is fully lowered, as shown in FIG. 8.

Referring to FIGS. 1 and 2, a preferred embodiment may also include a plurality of vertical extension plates 72 disposed between adjacent engagement members 28 and adapted to contact the carrier sheet 12 between the loops 44 thereof to ensure that the carrier sheet properly fits onto the cans 14. The extension plates 72 are particularly useful to fit a carrier sheet having non-circular loops onto the cans. The width z of the extension plates are less than the spacing between the fingers 60 of adjacent engagement members 28 so as not to interfere with the pivoting motion of the fingers. The extension plates 72 extend approximately 3/16 inch below the upper lip 40 of the can 14 when the lower plate 20 is fully lowered.

Referring to FIGS. 2, 3 and 8, the conical members 32 are formed of a solid polymeric material, such as nylon. The diameter r of the base 74 of the conical member 32 is slightly greater than the outer diameter t of the lip 40 of the can 14 to insure that the loop 44 of the carrier sheet 12 is fitted about the lip of the can while not overly stretching and deforming the loop. The conical member 32 tapers to a diameter u substantially smaller than the inner diameter v of the loops 44 of the carrier sheet 12 for permitting the carrier sheet to easily fit onto the conical members when they are seated on the cans. For carriers 12 having triangular openings, conical members 32 having a greater degree of taper are required for the carrier 12 to properly fit onto the conical members. The base 74 of the conical member is stepped at 76 approximately ¼ inch which provides vertical movement of the carrier 12 just prior to being fitted over the lip 40 of the can 14. The lower surface 78 of the base 74 has an annular ridge portion 80 having an outer diameter approximately the same as the inner diameter of the lip of the cans for maintaining the conical member properly centered on the upper surface 34 of the can. The annular ridge 80 has a beveled outer surface 82 to assist with the seating of the conical member on the can. Each conical member includes an axial bore 84 having an outwardly flared upper end 86.

The outer surface 36 of the conical members 32 include a plurality of radially-spaced grooves 86 for receiving the ends 70 of the fingers 60. The grooves 86 guide the movement of the fingers along the outer surface 36 of the conical members and allow the ends of the fingers to extend below the outer surface of the conical member to insure that the end of each finger properly engages the loop 44 of the carrier sheet 12. The depth of the groove 86 must be sufficiently shallow so that the base 74 of the conical member 32 extends beyond the lip of the can to prevent the fingers from contacting and damaging the lip.

The release mechanism 38, best shown in FIGS. 1 and 3, includes a plunger 88 slidably secured within the axial bore 90 of the tubular member 56 and disposed within the fingers 60 of each of the engagement members 28. Each plunger 88 includes a rod 92 and collar 94 which may be press fit onto the rod approximately one inch from its lower end 96. The tapered lower end 96 of the rod 92 is adapted to slidably engage the axial bore 84 of the conical member 32 to guide it onto the upper surface 34 of the can 14, to be described further hereinafter. The flared end 86 of the axial bore 84 of the conical member and the tapered lower end 96 of the rod 92 assist with the insertion of the rod into the bore 84 of the conical member. The rounded upper end 98 of the rod 92 extends through the tubular member 56 of the engagement means 28 and the opening 58 in the lower plate 20 so that the rod extends approximately ⅜ inches above the upper surface 26 of the lower plate. The diameter of the rod 92 is less than the diameter of the bore 100 of the tubular member 56 for providing free movement therethrough. The plunger 88 is retained in the engagement member 28 by a pin 102 secured in an opening 104 disposed in the upper end 98 of the rod 92.

The collar 94 is adapted to contact the tapered end 106 of the conical member 32 to eject it from the fingers 60 of the engagement means 28. In addition, the collar provides a stop for the lower plate 20 to prevent the fingers from being lowered more than approximately 3/16 inches below the lip 40 of the can 14.

The release mechanism 38 also includes a pair of slide members 108, 108 that slidably engage a pair of outer guide blocks 110, 110 and an inner guide block 112 secured to the upper surface 26 of the lower plate 20. The guide blocks 110, 112 include longitudinally extending slots 114 disposed in their side walls for receiving and guiding the slide members 108. A rear cross member 116 connects the rear ends of the slide members 108, 108 and a front cross member 118 connects the front ends of slide members so that the slide members concurrently move within the guide blocks 110, 112. A release handle 120 is secured to the front cross member 118 and extends far enough from the lower plate 20 to allow the operator to easily grasp and pull the handle away from the apparatus 10. The rear cross member 116 is connected to a pin 122 extending from the upper surface 26 of the lower plate 20 by a spring 124. The spring returns the slide members 108 to their original or reset position when the handle 120 is released in preparation for the next operation.

As best shown in FIGS. 3–7, a plurality of angled blocks 126, 126 are secured to the lower surface 128 of the slide members 108 for contacting the upper end 98 of the rod 92 of the plunger 88. The tapered surface 130 of each angled block 126 is oriented towards the front end of the slide members so when the release handle is pulled in the forward direction f, the tapered end of the block 126 initially contacts the rounded upper end 98 of the rod 92.

Figure 9:
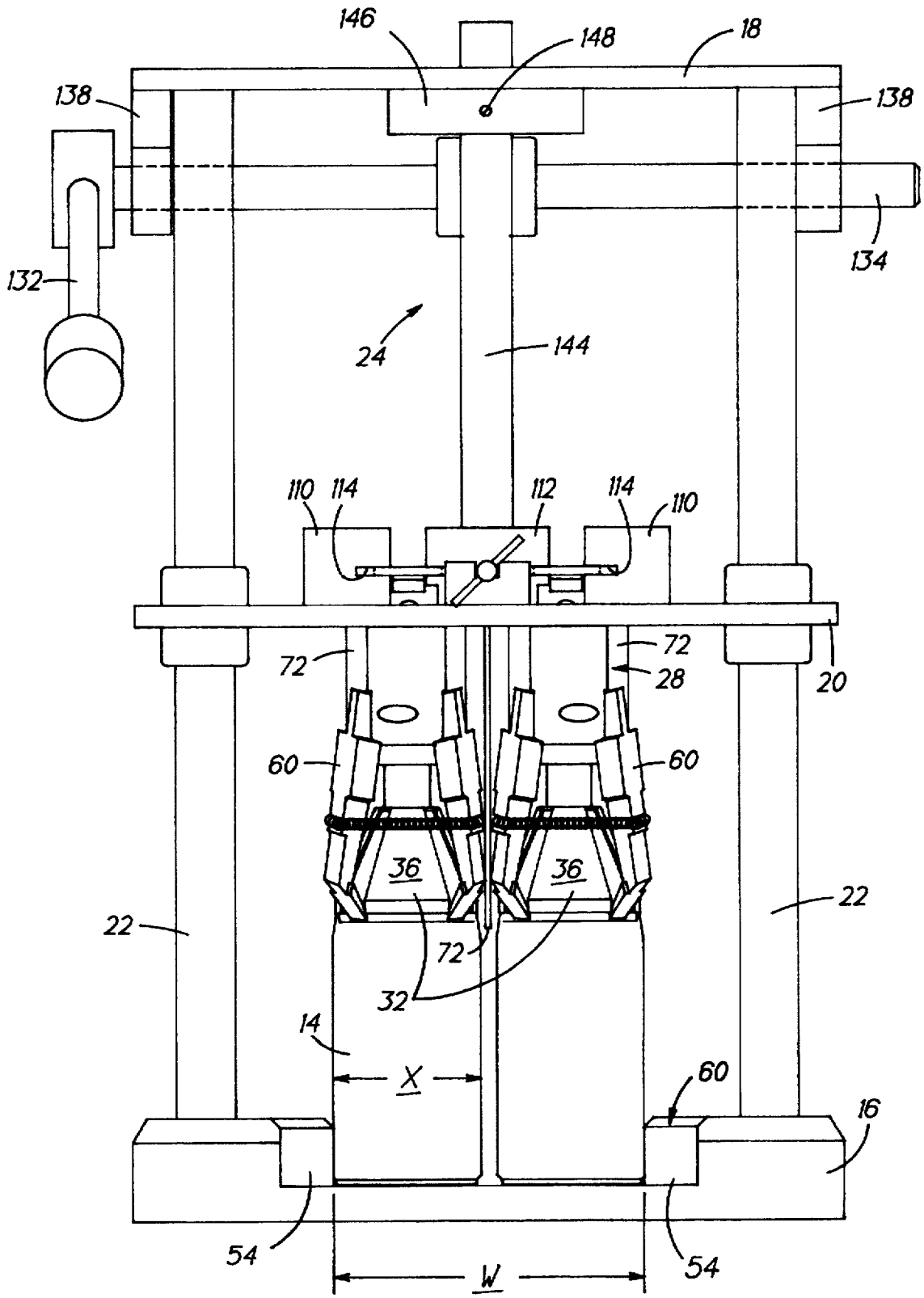
FIG. 9 is a front elevational view of the apparatus of FIG. 1.

Referring to FIGS. 2 and 9, the lifting means 24 includes a lever 132 and an axle 134 which extends from one side of the apparatus 10 to the other. The lever 132 may be removably fastened, such as by a set screw, to either end of the axle 134 to accommodate both a left and right-handed operator. The axle is secured to the bottom surface 136 of the upper plate 18 by two bushings 138, 138. One bushing 138 has an adjustment means 140, such as a set screw, to provide sufficient friction to maintain the lower plate 20 in place when in the uppermost position.

A pinion 142 is centrally affixed, such as by press fitting, to the axle 134 for engaging a rack 144. The rack is vertically disposed with one end thereof secured to the upper surface 26 of the lower plate 20 and the other end freely passes through a guide bushing 146 and an opening 150 in the upper plate 18. Rotation of the lever 132 raises and lowers the lower plate 20 along the vertical supports 22, 22 as the rack translates along the pinion. A location pin 148 extends from the guide bushing 146 to contact the rear surface 150 of the rack 144 and provide some degree of resistance to the travel of the lower plate 20. A dimple 152 is disposed on the rear surface of the rack and aligned to come in contact with the locator pin 80 during the travel of the rack. The dimple 84 is disposed on the rack 144 to engage the pin 148 when the conical members held by the engagement means are approximately 1 inch above the upper surface 34 of the cans 14 as shown in FIG. 3.

As shown in FIGS. 1 and 2, before operating the apparatus 10, the conical members 32 must be oriented within the engagement means 28 whereby the ends 70 of the fingers 60 are disposed within the lower end of the grooves 86 of the conical members 32. To operate the apparatus, the cans 14 are placed within the groove 86 of the base 16 so that they are centrally disposed below each of the engagement means 28.

To better illustrate the operation of the release mechanism 38 and engagement means 28, the release mechanism shown in FIGS. 3–7 are oriented 90 degrees from the orientation shown in FIG. 1. Referring to FIGS. 2 and 3, after the cans 14 are positioned in the groove 50, the operator rotates the lever 132 downward to lower the lower plate 20 until the operator feels the locator pin 148 engage the dimple 152 on the rear surface 150 of the rack 144 which positions the conical member approximately 1 inch above the upper surface 34 of the can.

Figure 4:
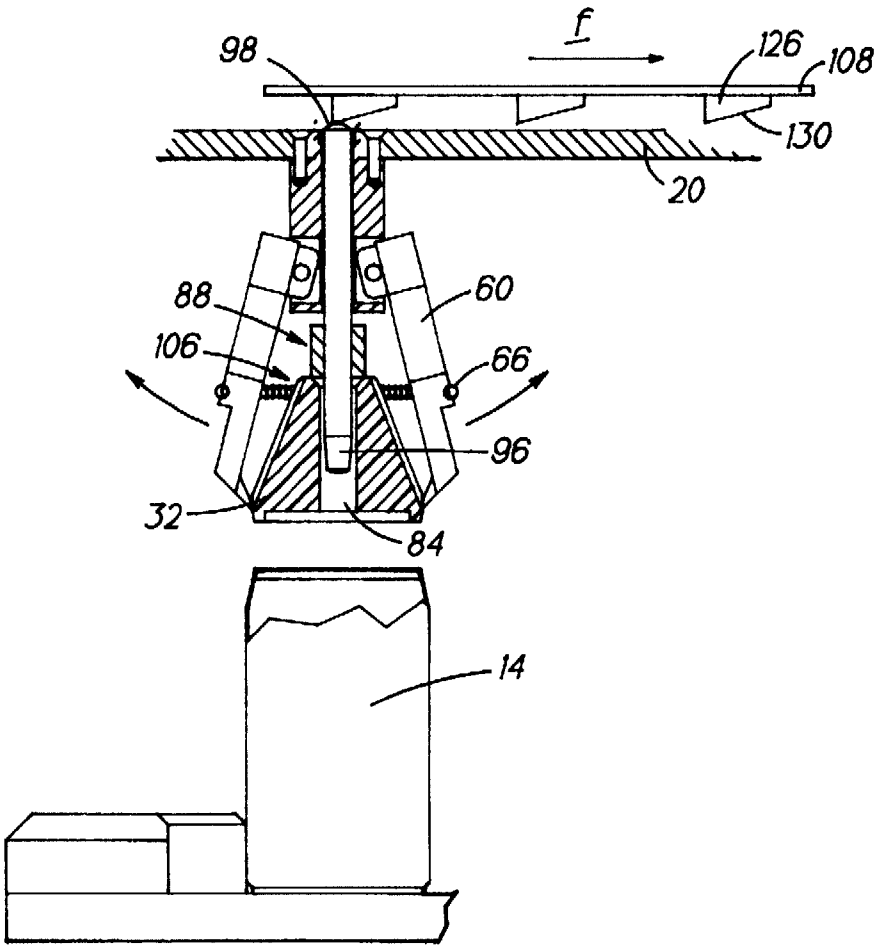
FIGS. 3–7 are partial elevational views of the steps of the operation of the apparatus of FIG. 1.

Referring to FIG. 4, the operator then pulls the release handle 120 in the direction of arrow f to eject the conical members 32 from the fingers 60 of the engagement means 28. When the release handle 120 is pulled, the angle blocks 126 mounted to the slide members 108 engage the upper end 98 of the rod 92 forcing the plunger 88 downward through the lower plate 20. The collar 94 of the plunger contacts the tapered end 96 of the conical member 32 and forces the conical members downward causing the fingers to pivot outwardly to thereby release the conical members from the grasp of the fingers 60 and dropping them onto the upper surface 34 of the cans 14. The tapered lower end 96 of the rod 92 disposed within the axial bore 84 of the conical member prevents it from tilting and guides it through the fingers and onto the cans.

Figures 5, 6:
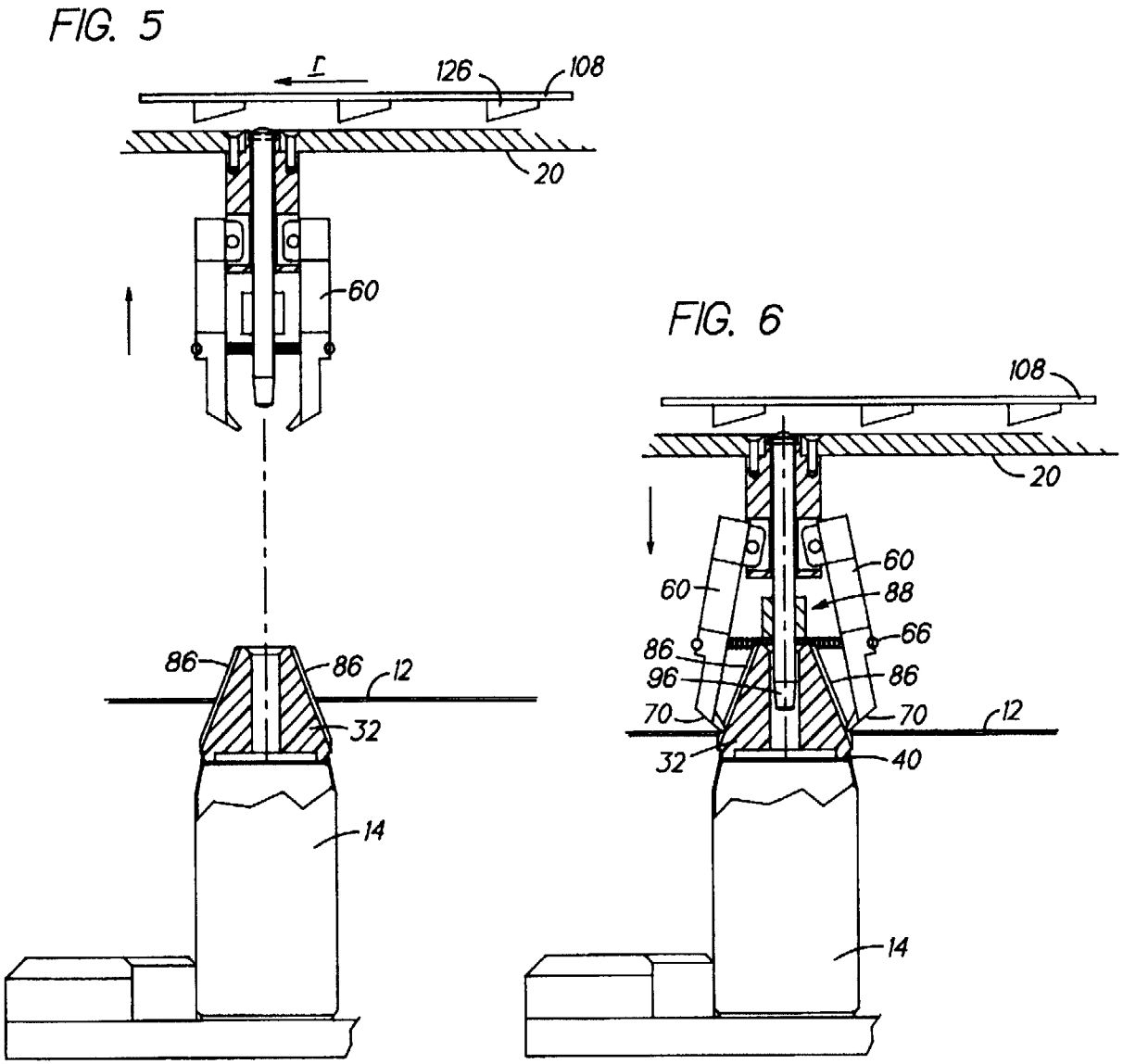

Referring to FIGS. 1 and 5, after the conical members 32 are ejected, the handle 120 is released and the return spring 124 pulls the slide members 108 in the rearward direction r to their original position. The lower plate 20 is then raised by rotating the lever 132 upward to a position clear of the conical members 32 to allow the carrier sheet 12 to be fitted onto the conical members.

As shown in FIG. 6, the lower plate 20 is then lowered again to fit the carrier 12 onto the can 14. As the lower plate is lowered, the ends 70 of the fingers 60 of the engagement member 28 drop into the grooves 86 disposed in the conical member 32 and slide downward to contact the carrier 12. The retention means 66 inwardly biases the fingers to insure continuous contact with the conical member. The loops 44 are forced downward along the outer surface 36 of the conical members gradually stretching the loop. The carrier sheet 12 is then slid over the conical member and about the upper lip 40 of the can 14.

In addition, as the lower plate 20 is dropped, the tapered end 96 of the plunger 88 is inserted into the conical member 32 as the conical member is inserted into the engagement member 28.

Referring to FIGS. 7 and 8, after the carrier sheet 12 is secured to the cans 14, the fingers 60 are inwardly urged by the retention means 66 to close about the base portion 74 of the conical member 32 for retaining the conical members in the proper orientation in the engagement means 28. The operator then raises the lower plate 20 for the next operation.

Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described my invention, what is claimed is:

1. An apparatus for attaching a plastic carrier sheet to containers to enable a number of containers to be carried as a single unit, the carrier sheet defining a plurality of openings disposed therein, the apparatus comprising:

a base;

at least one vertical support extending vertically from said base;

an upper plate secured to an upper portion of said vertical support;

a lower plate slidably supported by said vertical support between the base and the upper plate;

a plurality of engagement members secured to the lower plate;

a lifting means interconnected between said upper plate and lower plate for raising and lowering the lower plate;

a plurality of discrete generally cone-shaped members disposed within the engagement means, each of said members having an outer surface; and a release mechanism secured to the lower plate adapted to release the conical members from the engagement means.

2. An apparatus for attaching a plastic carrier sheet to containers, as set forth in claim 1, wherein each of said engagement means comprises:

a tubular member secured to said lower plate;

a plurality of engagement fingers pivotally connected to said tubular member; and a retention means disposed about said fingers for urging ends of said fingers together.

3. An apparatus for attaching a plastic carrier sheet to containers, as set forth in claim 2, wherein the ends of said fingers extend inwardly to engage the outer surface of the conical member.

4. An apparatus for attaching a plastic carrier sheet to containers, as set forth in claim 2, wherein the engagement means comprises four engagement fingers equi-spaced about the tubular member.

5. An apparatus for attaching a plastic carrier sheet to containers, as set forth in claim 2, wherein said conical members each have an axial bore; a plurality of longitudinally extending grooves disposed on its outer surface adapted to receive the ends the fingers of the engagement means, a wide portion having an outer diameter greater than the diameter of the upper rim of the container.

6. An apparatus for attaching a plastic carrier sheet to containers, as set forth in claim 2, wherein said conical members include a centrally disposed annular ridge having an outer diameter approximately equal to the inner diameter of the upper rim of the container.

7. An apparatus for attaching a plastic carrier sheet to containers, as set forth in claim 2, wherein said wide portion of the conical members has an stepped outer surface of predetermined width.

8. An apparatus for attaching a plastic carrier sheet to containers, as set forth in claim 3, wherein said lifting means comprises an axle slidably secured to the upper plate; a pinion secured to the axle; a rack engaging said pinion having one end thereof connected to an upper surface of the lower plate.

9. An apparatus for attaching a plastic carrier sheet to containers, as set forth in claim 3, wherein said lifting means further comprising a bushing secured to the upper plate; said rack having a back surface; said back surface having a dimple disposed therein located at a point when the lower surface above the upper surface of the containers at predetermined distance; and a pin disposed therein adapted to engaged the, back surface of the rack and the indent for providing an indication to the operator when the lower plate is properly positioned to release the conical members from the engagement means.

10. An apparatus for attaching a plastic carrier sheet to containers, as set forth in claim 4, wherein said release mechanism comprising:

a plunger including a rod and a collar disposed a predetermined distance from one end of the rod; one end of the rod is adapted to engage the conical member and the other end is slidably maintained in the bore disposed through the tubular member and an opening in the lower plate; and a slide means for forcing the plunger downward to eject the conical members from the engagement means.

11. An apparatus for attaching a plastic carrier sheet to containers, as set forth in claim 4, wherein said slide means comprising:

a plurality of slide blocks secured to the upper surface of the lower plate;

a pair of slide members slidably engaging said slide blocks a predetermined distance above the upper surface of the lower plate and plungers;

a plurality of angle blocks secured to the lower surface of the slides, said angle blocks having a chamfered lower surface adapted to engage the other end of the rod to force the plunger downward when slid across the chamfered surface;

a handle for longitudinally sliding the slide members; and a recoil means connected to the upper surface of the lower plate and the other ends of the slide members for returning the slide members to a position where the angle blocks are clear of the rods.

12. An apparatus for attaching a plastic carrier sheet to containers, as set forth in claim 5, further comprises at least one insertion plate disposed between a plurality of engagement means, said insertion plate extends from the bottom surface of the lower plate at least as far as said engagement means.

13. An apparatus for attaching a plastic carrier sheet to containers, as set forth in claim 6, wherein said base having a groove disposed therein, said groove being dimensioned for positioning the containers for proper engagement with said engagement means.

14. A method for attaching a plastic carrier sheet to a plurality of containers, the plastic carrier defining a plurality of openings disposed therein in a predetermined pattern, each container having an upper lip portion dispose about the outer periphery of the container that extends outwardly from a body portion of the container, comprising the steps of:

arranging the containers in the predetermined pattern of the openings of the plastic carrier;

securing a discrete generally cone-shaped member within a retention means disposed above each container;

ejecting each cone-shaped member from each retention means onto an upper surface of each container;

fitting the carrier onto the cone-shaped members;

lowering the retention means downwardly to engage the carrier and stretch the carrier over the cone-shaped members and the upper lip portion of each of the containers and onto the body portions of the containers; and raising the retention means for securing and lifting the cone-shaped members away from the containers.

* * * * *